US008232521B2

(12) United States Patent
Jarrell et al.

(10) Patent No.: US 8,232,521 B2
(45) Date of Patent: Jul. 31, 2012

(54) DEVICE AND METHOD FOR ANALYZING A SAMPLE

(75) Inventors: Joseph A. Jarrell, Newton Highlands, MA (US); Michael J. Tomany, Thompson, CT (US)

(73) Assignee: Waters Technologies Corporation, Milford, MA (US)

( * ) Notice: Subject to any disclaimer, the term of this patent is extended or adjusted under 35 U.S.C. 154(b) by 201 days.

(21) Appl. No.: 12/524,620

(22) PCT Filed: Feb. 1, 2008

(86) PCT No.: PCT/US2008/052768

§ 371 (c)(1),
(2), (4) Date: Feb. 17, 2010

(87) PCT Pub. No.: WO2008/097831

PCT Pub. Date: Aug. 14, 2008

(65) Prior Publication Data

US 2010/0148057 A1 Jun. 17, 2010

Related U.S. Application Data

(60) Provisional application No. 60/887,897, filed on Feb. 2, 2007, provisional application No. 60/911,566, filed on Apr. 13, 2007, provisional application No. 60/941,004, filed on May 31, 2007.

(51) Int. Cl.
*H01J 49/00* (2006.01)

(52) U.S. Cl. ..... 250/288; 250/281; 250/282

(58) Field of Classification Search ..... 250/288, 250/281, 282, 283, 285
See application file for complete search history.

(56) References Cited

U.S. PATENT DOCUMENTS

| | | | | |
|---|---|---|---|---|
| 5,581,081 | A * | 12/1996 | Kato et al. | 250/288 |
| 6,114,693 | A * | 9/2000 | Hirabayashi et al. | 250/288 |
| 6,452,166 | B1 * | 9/2002 | Enke et al. | 250/288 |
| 6,949,741 | B2 | 9/2005 | Cody et al. | |
| 7,091,477 | B2 | 8/2006 | Jolliffe et al. | |
| 7,112,785 | B2 | 9/2006 | Laramee et al. | |

(Continued)

FOREIGN PATENT DOCUMENTS

EP 1720012 A1 * 11/2006

OTHER PUBLICATIONS

Dry Surface Cleaning Using CO2 Snow; Robert Sherman et al.; J. Vac Sci. Technol. B 9 (4), Jul./Aug. 1991; 8 pages.

(Continued)

*Primary Examiner* — Robert Kim
*Assistant Examiner* — Jason McCormack
(74) *Attorney, Agent, or Firm* — Guerin + Rodriguez, LLP

(57) ABSTRACT

Embodiments of the invention relate to a device for analyzing a sample surface Comprising an outlet and a frame. The outlet is for forming a jet of gas, the jet forming a sampling region for receiving one or more sample surfaces, and the frame holding the outlet and being adapted to receive a detector means. The detector means has an inlet. In use, the jet produces desorbed sample from sample surfaces received in the sample area. At least a portion of the desorbed sample is ionized to produce one or more sample ions. The frame holds the outlet with respect to the sample ions and produce a signal indicative of the composition of the sample ions.

34 Claims, 7 Drawing Sheets

U.S. PATENT DOCUMENTS

| | | | | |
|---|---|---|---|---|
| 7,138,626 | B1 | 11/2006 | Karpetsky | |
| 7,170,053 | B2 | 1/2007 | Shvartsburg et al. | |
| 7,193,223 | B2 * | 3/2007 | Franzen | 250/425 |
| 7,335,897 | B2 | 2/2008 | Takats et al. | |
| 7,411,186 | B2 * | 8/2008 | Mordehai | 250/288 |
| 7,442,919 | B2 * | 10/2008 | Ishiuchi | 250/251 |
| 7,473,560 | B2 * | 1/2009 | Soldin | 436/173 |
| 7,544,933 | B2 | 6/2009 | Cooks et al. | |
| 7,847,244 | B2 | 12/2010 | Venter et al. | |
| 2002/0125426 | A1 * | 9/2002 | Hirabayashi et al. | 250/288 |
| 2005/0199800 | A1 * | 9/2005 | Harada | 250/288 |
| 2006/0186334 | A1 * | 8/2006 | Jolliffe et al. | 250/288 |
| 2006/0255261 | A1 * | 11/2006 | Whitehouse et al. | 250/288 |
| 2006/0285108 | A1 * | 12/2006 | Morrisroe | 356/316 |
| 2007/0023677 | A1 * | 2/2007 | Perkins et al. | 250/425 |
| 2007/0272852 | A1 * | 11/2007 | Miller et al. | 250/288 |
| 2008/0067352 | A1 * | 3/2008 | Wang | 250/288 |

OTHER PUBLICATIONS

The Frictional Charging of Metals by a Carbon Dioxide Spray; J. Hart et al.; J. Phys. D: Appl. Phys., vol. 8, 1975; 7 pages.

Mechanism of Surface Charging during CO2 Jet Spray Cleaning; M. M. Hills; J. Vac. Sci. Technol. A 13(2), Mar./Apr. 1995; 9 pages.

* cited by examiner

DEVICE AND METHOD FOR ANALYZING A SAMPLE

CROSS REFERENCE TO RELATED APPLICATIONS

This application is the National Stage of International Application No. PCT/US2008/052768, filed Feb. 1, 2008, which claims priority to and benefit of U.S. Provisional Patent Application Ser. No. 60/887,897, filed Feb. 2, 2007, U.S. Provisional Patent Application Ser. No. 60/911,566, filed Apr. 13, 2007 and U.S. Provisional Patent Application Ser. No. 60/941,004, filed May 31, 2007. The entire contents of these applications are incorporated herein by reference.

STATEMENT WITH RESPECT TO FEDERAL SPONSORSHIP

The present invention was made without Federal sponsorship or funds.

FIELD OF THE INVENTION

The present invention relates to a device and method for analyzing the surface of a sample.

BACKGROUND OF THE INVENTION

Ion analysis devices such as mass spectrometers have been used to great effect to analyze and characterize samples both simple and complex. Such devices require samples to be ionized so that mass to charge ratio (m/z) may be measured by various methods of manipulation of the ions. Early ion sources involved such methods as the bombarding of samples with electrons. These methods, however, often caused ions to be produced with very high energy, which left them liable to fragment. Later, so called "soft" ionization techniques, notably electrospray, atmospheric pressure chemical ionization (APCI) and matrix assisted laser desorption ionization (MALDI), were developed, each of which enabled sample ion fragmentation to be better controlled, and for sample ions to be detected in their entirety.

The analysis of solid samples and surfaces with on analysis devices has always provided particular challenges, as traditional soft ionization techniques are appropriate only to the analysis of liquid samples or samples held in solution. Certain industries however, such as food, homeland security, and forensics, would find great benefit in a source able to effectively produce molecular or pseudo molecular ions from a solid sample without significant damage to the surface.

SUMMARY OF THE INVENTION

Embodiments of the present invention relate to a device for analysing a sample surface comprising an outlet and a frame. The outlet is for forming a jet of carbon dioxide, the jet forming a sampling region for receiving one or more sample surfaces, and the frame holding the outlet and being adapted to receive a detector means. The detector means has an inlet.

In use, the jet produces desorbed sample from sample surfaces received in the sample area. At least a portion of the desorbed sample is ionized to produce one or more sample ions. The frame holds the outlet with respect to the sampling area and the inlet to allow the detector means to receive the sample ions and produce a signal indicative of the composition of the sample ions.

Preferably, the device further comprises a detector having an inlet configured to receive the sample ions. Preferably, the inlet is held at an elevated potential. More preferably, the inlet is held at a potential between 50V and 100V.

Preferably, the device further comprises a heater in thermal communication with the inlet. The inlet is preferably maintained at a temperature of between 70° C. and 200° C.

In preferred embodiments, the detector means is selected from the group comprising: mass spectrometer, ion mobility spectrometer.

In some embodiments, the outlet is held at elevated potential.

In some preferred embodiments, the device further comprises a discharge member held by the frame proximal to the outlet, for affecting a discharge such that at least a further portion of the desorbed sample is ionized to produce further sample ions. The discharge member is preferably held at a potential of 2000V to 6000V. Preferably, a resistor is provided in electrical series with the discharge member. The resistor preferably provides a resistance of 100MΩ to 6000MΩ. Alternatively the discharge member may be attached to a current regulated high voltage supply.

In other preferred embodiments, the device further comprises an aerosol source proximal to the outlet for directing an aerosol toward the sampling region.

The aerosol source may comprise a pneumatic nebuliser. In some embodiments the aerosol comprises methanol or water-methanol mixtures and in further embodiments the aerosol may further comprise acetic acid or acetic acid-water mixtures. In a further embodiment, the aerosol source may consist simply of a source of heated nitrogen or other inert gas.

In other preferred embodiments, the device further comprises an electrospray needle secured to the frame. The electrospray needle is for directing charged solvent droplets toward said sampling region, such that at least a further portion of the desorbed sample is ionized to produce further sample ions.

In other preferred embodiments, the device further comprises a lamp secured to the frame. The lamp provides electromagnetic radiation to the sampling region. Preferably, the device also comprises a dopant outlet secured to the frame. The dopant outlet provides a dopant to the sampling region, wherein the dopant is ionized by the electromagnetic radiation to produce dopant ions. The dopant ions ionize a further portion of desorbed sample to produce further sample ions. Preferably, the electromagnetic radiation comprises ultraviolet radiation.

Preferably, the device is operated at atmospheric pressure.

Preferably, the jet is subject to a Joule-Thomson expansion.

Preferably, the outlet is movable, enabling optimization of signal strength produced by the detector.

Preferably, an insulating jacket surrounds the outlet.

Other preferred embodiments of the present invention relate to a device for analysing a sample surface comprising an outlet and a frame. The outlet is for forming a jet of a Joule-Thomson cooling gas, the jet forming a sampling region for receiving one or more sample surfaces, and the frame holding the outlet and being adapted to receive a detector means. The detector means has an inlet.

In use, the jet produces desorbed sample from sample surfaces received in the sample area. At least a portion of the desorbed sample is ionized to produce one or more sample ions. The frame holds the outlet with respect to the sampling area and the inlet to allow the detector means to receive the sample ions and produce a signal indicative of the composition of the sample ions.

Preferably, the Joule-Thomson cooling gas comprises $N_2O$.

Other preferred embodiments of the present invention relate to a device for analysing a sample surface comprising an outlet, a detector and a frame. The outlet is for forming a jet of carbon dioxide, the jet forming a sampling region for receiving one or more sample surfaces. The detector means has an inlet. The frame holds the outlet and the detector means.

In use, the jet produces desorbed sample from sample surfaces received in the sample area. At least a portion of the desorbed sample is ionized to produce one or more sample ions. The frame holds the outlet with respect to the sampling area and the inlet to allow the detector means to receive the sample ions and produce a signal indicative of the composition of the sample ions.

Further embodiments of the invention relate to a device for analysing a sample surface comprising an outlet and a frame. The outlet is for forming a jet of gas, the jet forming a sampling region for receiving one or more sample surfaces, and the frame holding the outlet and being adapted to receive a detector means. The detector means has an inlet.

In use, the jet produces desorbed sample from sample surfaces received in the sample area. At least a portion of the desorbed sample is ionized to produce one or more sample ions. The frame holds the outlet with respect to the sampling area and the inlet to allow the detector means to receive the sample ions and produce a signal indicative of the composition of the sample ions. Preferably, the gas is selected from the group comprising: carbon dioxide, nitrous oxide, propane, ethane, ethylene, Freon 11, Freon 21, Freon 22, Freon 23, Freon 152A 1,1-difluoroethane.

Further embodiments of the invention relate to a device for analysing a sample surface comprising an outlet and a frame. The outlet is for forming a jet of gas, the jet forming a sampling region for receiving one or more sample surfaces, and the frame holding the outlet and being adapted to receive a detector means. The detector means has an inlet.

In use, the jet produces desorbed sample from sample surfaces received in the sample area. The frame holds the outlet with respect to the sampling area and the inlet to allow the detector means to receive the desorbed sample and produce a signal indicative of the composition of the sample. Preferably, the gas is selected from the group comprising: carbon dioxide, nitrous oxide, propane, ethane, ethylene, Freon 11, Freon 21, Freon 22, Freon 23, Freon 152A 1,1-difluoroethane. Preferably the detector means is selected from the group comprising gas chromatographs, Fourier Transform Infrared spectroscopes, and detectors based on amplifying fluorescent polymers.

Other preferred embodiments relate to a method of ionizing a sample comprising the steps of:

(i) Providing an outlet, a detector and a frame. The outlet is for forming a jet of carbon dioxide, the jet forming a sampling region for receiving one or more sample surfaces and said frame holding said outlet and the detector means. The detector means has an inlet.

(ii) Positioning a sample in the sampling region.

(iii) Forming a jet of carbon dioxide such that the jet produces desorbed sample from the sample surfaces received in the sampling region. At least a portion of the desorbed sample is ionized to produce one or more sample ions. The frame holds the outlet with respect to the sampling region and the inlet to allow the detector means to receive the sample ions and produce a signal indicative of the composition of the sample ions.

In some preferred embodiments, the method further comprises the steps of:

(i) Providing a discharge member secured to the frame proximal to the outlet.

(ii) Applying a potential to the discharge member to affect a discharge such that a further portion of the desorbed sample is ionized to produce further sample ions.

Preferably, the step of applying a potential to the discharge member comprises applying a voltage of 2000V to 6000V to the discharge member.

In other preferred embodiments, the method further comprises the steps of:

(i) Providing an aerosol source secured to the frame proximal to the outlet.

(ii) Directing an aerosol from the aerosol source toward the sampling region.

In other preferred embodiments, the method further comprises the steps of:

(i) Providing an electrospray needle secured to the frame proximal to the outlet. The electrospray needle is for directing charged solvent droplets toward the sampling region.

(ii) Applying a potential to the electrospray needle.

(iii) Directing charged solvent droplets towards the sampling region such that at least a further portion of desorbed sample is ionized to produce further sample ions.

In other preferred embodiments, the method further comprises the steps of:

(i) Providing a lamp secured to the frame and a dopant outlet secured to the frame. The lamp is to provide electromagnetic radiation to the sampling region and the dopant outlet is to provide a dopant to the sampling region;

(ii) Directing a dopant towards the sampling region such that the dopant is ionized by the electromagnetic radiation to produce dopant ions. The dopant ions ionize a further portion of desorbed sample to produce further sample ions.

DETAILED DESCRIPTION OF THE INVENTION

At ambient temperatures, carbon dioxide exists as a liquid when held under pressures around 43 atmospheres and above. When this liquid is allowed to flow through an orifice and expand into a region at atmospheric pressure, the process of Joule-Thomson expansion occurs.

Joule-Thomson expansion is the process by which a fluid changes temperature in response to a change in pressure. Some fluids, including carbon dioxide, decrease in temperature when allowed to expand into a region of atmospheric pressure. In the case of carbon dioxide, the cooling is so pronounced when expanding from high pressure conditions, such as when stored as a liquid, to atmospheric pressure, that solid carbon dioxide may be formed.

The inventors have discovered that the aiming of a beam of a rapidly expanding beam of carbon dioxide at a surface produces ions representative of that surface or of compounds on that surface. The ions formed are typically pseudo-molecular ions of the (M+H)+, where the neutral species M is ionized by addition of a proton H+. Such (M+H)+ pseudo-molecular ions are also commonly formed in ionization techniques such as laser desorption ionization, often used in conjunction with mass spectrometry devices.

Accordingly, embodiments of the present invention relate to devices and methods of ionizing samples from or on a given surface and detecting those ions to produce a signal indicative of their identity.

Figure 1:
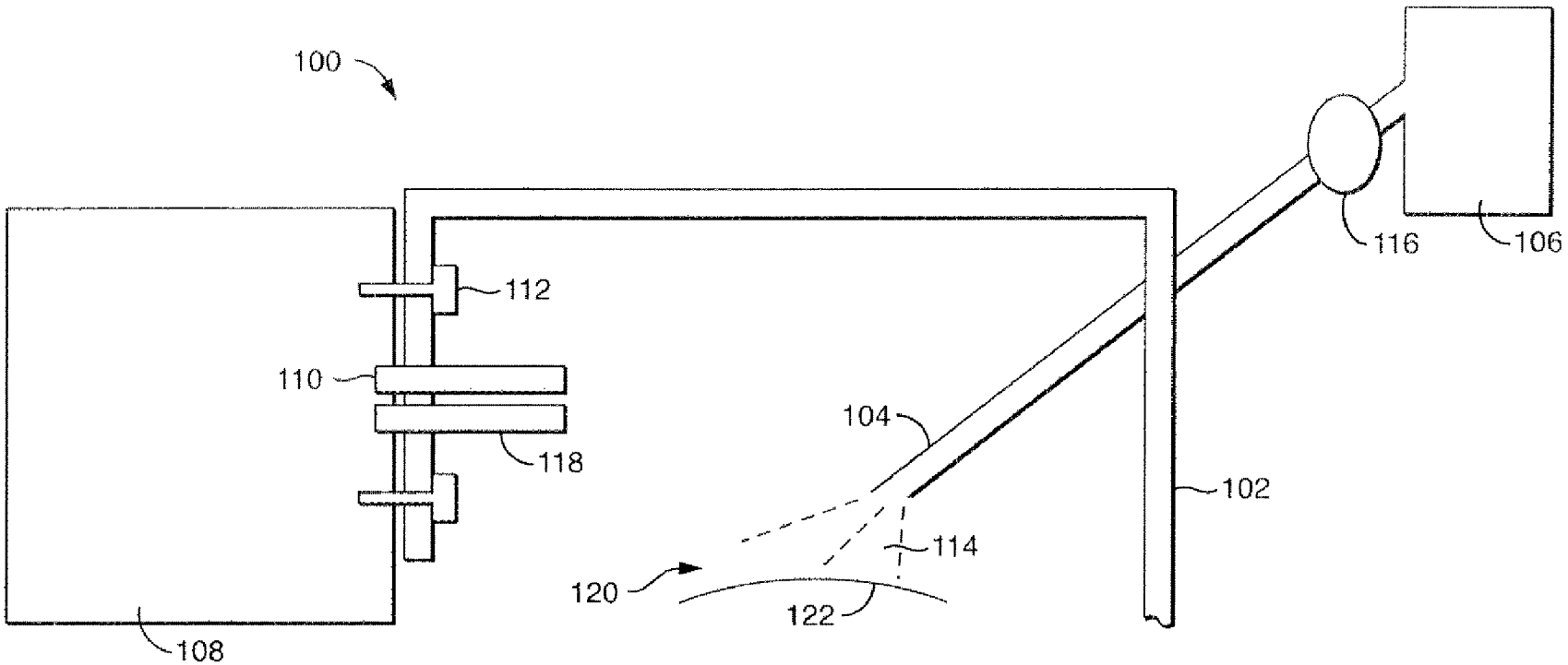
FIG. 1 shows a preferred embodiment of the invention.

A first embodiment of the invention is shown in FIG. 1. A device 100 comprises a frame 102 holding an outlet 104. Outlet 104 may comprise, for example, a tube, pipe or capillary, and is in fluid communication with valve 116, in turn in fluid communication with fluid source 106. Preferably, fluid source 106 contains carbon dioxide under elevated pressure. Valve 116 controls the release of carbon dioxide from fluid source 106 through outlet 104 to affect a jet 114 which forms a sampling region 120. Frame 102 is adapted to receive detector 108 having an inlet 110. Heater 118 is held in thermal communication with inlet 110. Frame 102 may be secured to detector 108 by such means as bolts 112, or by other such means as known in the art. In certain embodiments, an insulating jacket surrounds outlet 104, preventing the build-up of frost. In other preferred embodiments, outlet 104 is movably secured to said frame such that the direction of jet 114 may be adjusted to affect ionization efficiency.

In operation, a sample 122 is placed in sample region 120. Sample 122 may be presented on a surface. Alternatively, sample 122 may be a surface part of a surface itself.

Valve 116 is opened to emit a jet 114 of carbon dioxide from outlet 104 toward sample region 120. Jet 114 of carbon dioxide undergoes Joule-Thomson cooling which causes at least a portion of the jet 114 to form solid carbon dioxide. At least a portion of the sample is desorbed, with a portion of the desorbed sample being ionized to form sample ions. In preferred embodiments, outlet 104 is held at ground potential while emitting jet 114. In other preferred embodiments, outlet 104 is held at elevated potential while emitting jet 114.

A potential may be applied to inlet 110. Preferably, the potential applied to inlet 110 is between 50V and 100V. Heater 118 applies heat to inlet 110, preventing build-up of frost which could prevent sample ions from efficiently entering detector 108. Detector 108 is operated at a lower pressure than the sampling region, causing the sample ions to drift through inlet 110.

In some preferred embodiments, detector 108 is a mass spectrometer. In other preferred embodiments, detector 108 is an ion mobility spectrometer. Detector 108 is operated to produce a signal indicative of the identity of the sample ions. Ion mobility spectrometers that operate at ambient pressure are also known and can likewise be used to analyze ions produced by this invention.

Figure 2:
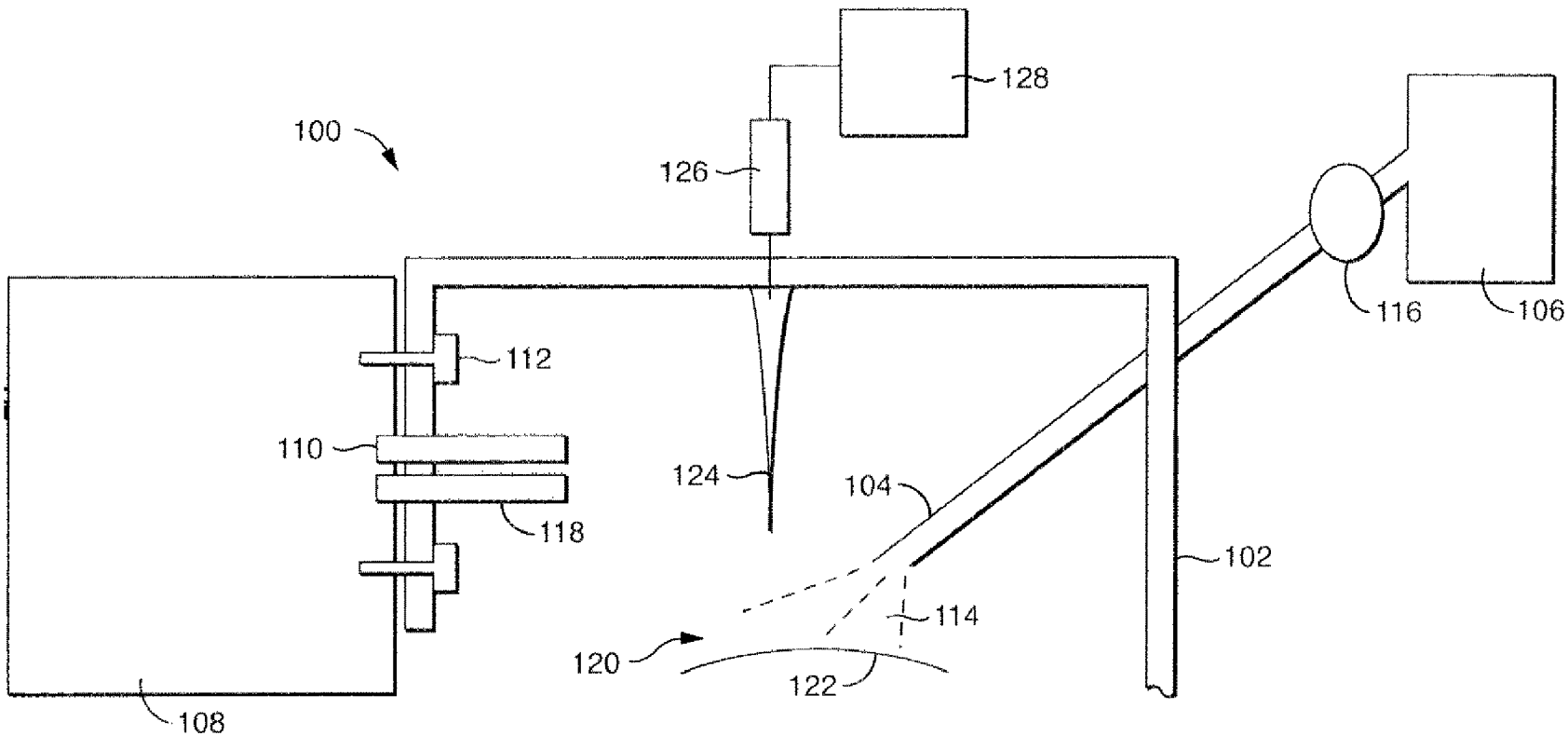
FIG. 2 shows a preferred embodiment of the invention.

A further embodiment of the invention is shown in FIG. 2. A device 100 comprises a frame 102 holding an outlet 104. Outlet 104 may comprise, for example, a tube, pipe or capillary, and is in fluid communication with valve 116, in turn in fluid communication with fluid source 106. Preferably, fluid source 106 contains carbon dioxide under elevated pressure. Valve 116 controls the release of carbon dioxide from fluid source 106 through outlet 104 to affect a jet 114 which forms a sampling region 120. Frame 102 is adapted to receive detector 108 having an inlet 110. Heater 118 is held in thermal communication with inlet 110. Frame 102 may be secured to detector 108 by such means as bolts 112, or by other such means as known in the art. Discharge member 124 is secured to frame 102 to extend approximately between outlet 104 and inlet 110. In electrical series with discharge member 124 is resistor 126 and power supply 128.

In operation, a sample 122 is placed in sample region 120. Sample 122 may be presented on a surface. Alternatively, sample 122 may be a surface part of a surface itself.

Valve 116 is opened to emit a jet 114 of carbon dioxide from outlet 104 toward sample region 120. Jet 114 of carbon dioxide undergoes Joule-Thomson cooling which causes at least a portion of the jet 114 to form solid carbon dioxide. At least a portion of the sample is desorbed, with a portion of the desorbed sample being ionized to form sample ions. Power supply 128 elevates discharge member 124 to a potential between 2000V and 6000V. Resistor has a resistance between 100MΩ and 6000MΩ, keeping current during discharge in the μA range. Discharge member 124 causes ionization of a further portion of the desorbed sample. Alternatively, discharge member 124 may be driven by a current regulated high voltage supply (not shown).

In preferred embodiments, outlet 104 is held at ground potential while emitting jet 114. In other preferred embodiments, outlet 104 is held at elevated potential while emitting jet 114.

A potential may be applied to inlet 110. Preferably, the potential applied to inlet 110 is between 50V and 100V. Heater 118 applies heat to inlet 110, preventing build-up of frost which could prevent sample ions from efficiently entering detector 108. Detector 108 is operated at a lower pressure than the sampling region, causing the sample ions to drift through inlet 110.

In some preferred embodiments, detector 108 is a mass spectrometer. In other preferred embodiments, detector 108 is an ion mobility spectrometer. Detector 108 is operated to produce a signal indicative of the identity of the sample ions. Ion mobility spectrometers that operate at ambient pressure are also known and can likewise be used to analyze ions produced by this invention.

Figure 3:
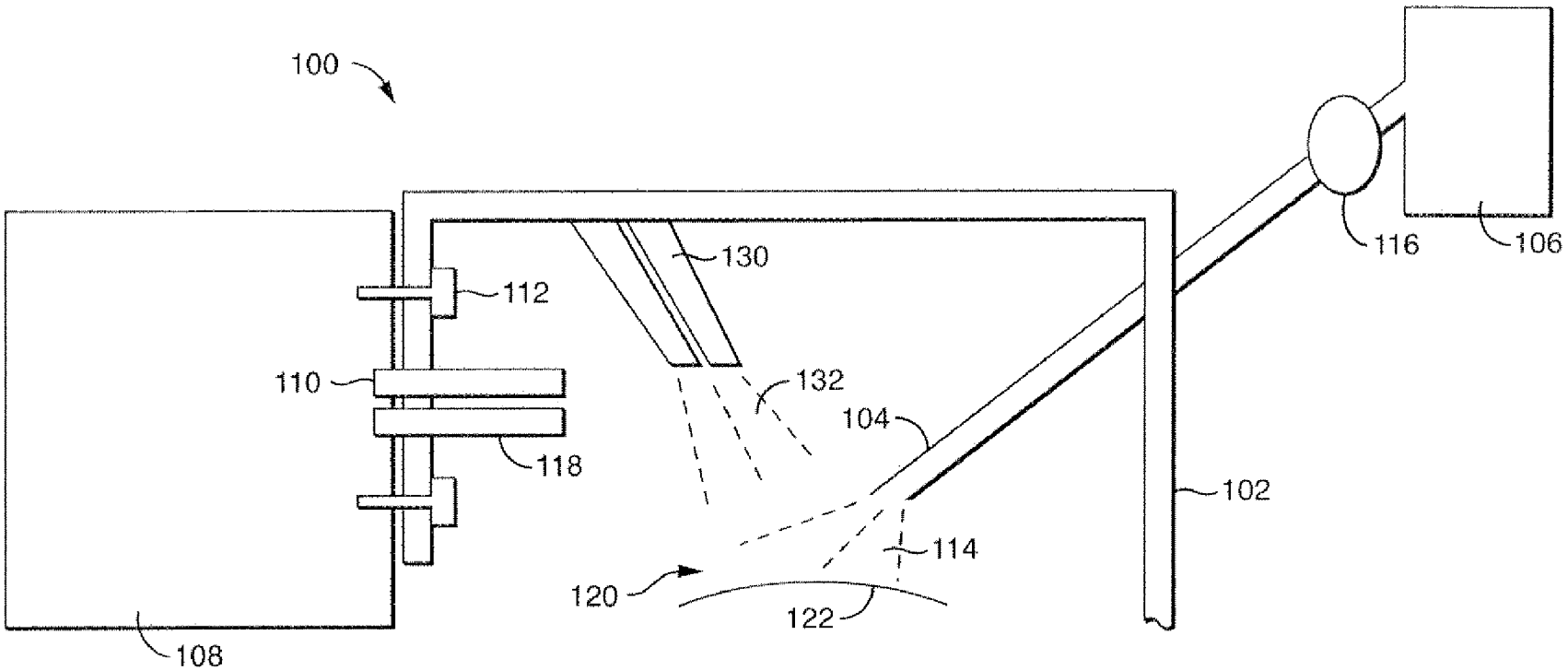
FIG. 3 shows a preferred embodiment of the invention.

A further embodiment of the invention is shown in FIG. 3. A device 100 comprises a frame 102 holding an outlet 104. Outlet 104 may comprise, for example, a tube, pipe or capillary, and is in fluid communication with valve 116, in turn in fluid communication with fluid source 106. Preferably, fluid source 106 contains carbon dioxide under elevated pressure. Valve 116 controls the release of carbon dioxide from fluid source 106 through outlet 104 to affect a jet 114 which forms a sampling region 120. Frame 102 is adapted to receive detector 108 having an inlet 110. Heater 118 is held in thermal communication with inlet 110. Frame 102 may be secured to detector 108 by such means as bolts 112, or by other such means as known in the art. Aerosol source 130 is secured to frame 102 such that an aerosol 132 may be directed towards sampling region 120.

In operation, a sample 122 is placed in sample region 120. Sample 122 may be presented on a surface. Alternatively, sample 122 may be a surface part of a surface itself.

Valve 116 is opened to emit a jet 114 of carbon dioxide from outlet 104 toward sample region 120. Jet 114 of carbon dioxide undergoes Joule-Thomson cooling which causes at least a portion of the jet 114 to form solid carbon dioxide. At least a portion of the sample is desorbed, with a portion of the desorbed sample being ionized to form sample ions. Aerosol source 130 emits aerosol 132 towards sampling region 120, to blanket the area impacted by jet 114, preventing frost build-up over prolonged use. Aerosol 132 may comprise methanol nebulized with nitrogen gas. Additionally, aerosol source 130 may be replaced by a source of heated nitrogen gas directed towards sampling region 120.

In preferred embodiments, outlet 104 is held at ground potential while emitting jet 114. In other preferred embodiments, outlet 104 is held at elevated potential while emitting jet 114.

A potential may be applied to inlet 110. Preferably, the potential applied to inlet 110 is between 50V and 100V. Heater 118 applies heat to inlet 110, preventing build-up of frost which could prevent sample ions from efficiently entering detector 108. Detector 108 is operated at a lower pressure than the sampling region, causing the sample ions to drift through inlet 110.

In some preferred embodiments, detector 108 is a mass spectrometer. In other preferred embodiments, detector 108 is an ion mobility spectrometer. Detector 108 is operated to produce a signal indicative of the identity of the sample ions. Ion mobility spectrometers that operate at ambient pressure are also known and can likewise be used to analyze ions produced by this invention.

Figure 4:
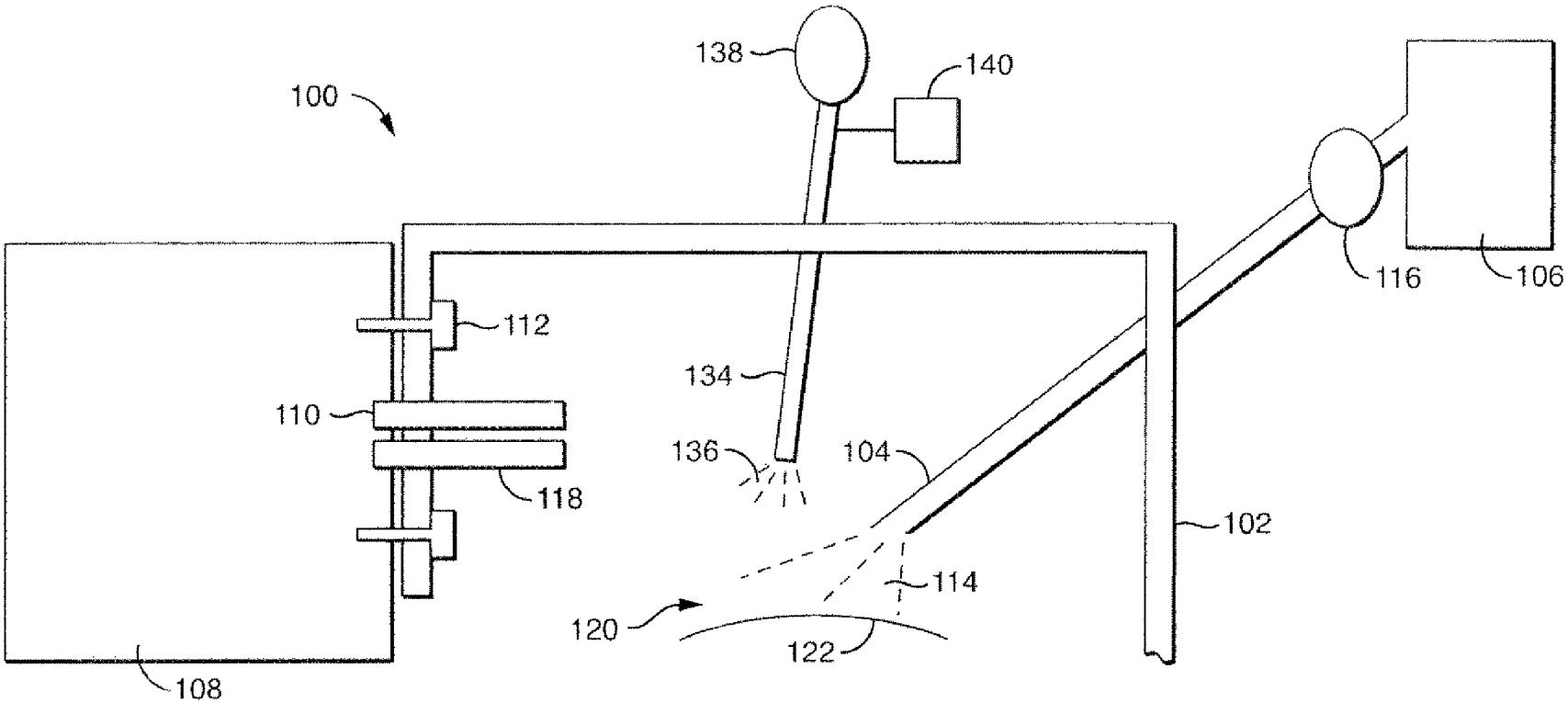
FIG. 4 shows a preferred embodiment of the invention.

A further embodiment of the invention is shown in FIG. 4. A device 100 comprises a frame 102 holding an outlet 104. Outlet 104 may comprise, for example, a tube, pipe or capillary, and is in fluid communication with valve 116, in turn in fluid communication with fluid source 106. Preferably, fluid source 106 contains carbon dioxide under elevated pressure. Valve 116 controls the release of carbon dioxide from fluid source 106 through outlet 104 to affect a jet 114 which forms a sampling region 120. Frame 102 is adapted to receive detector 108 having an inlet 110. Heater 118 is held in thermal communication with inlet 110. Frame 102 may be secured to detector 108 by such means as bolts 112, or by other such means as known in the art. Electrospray needle 134 is secured to frame 102 such that it may spray a charged solvent 136 from solvent source 138 towards a region between sample region 120 and inlet 110. Power supply 140 is connected in electrical series with electrospray needle 134 to hold electrospray needle at elevated potential.

In operation, a sample 122 is placed in sample region 120. Sample 122 may be presented on a surface. Alternatively, sample 122 may be a surface part of a surface itself.

Valve 116 is opened to emit a jet 114 of carbon dioxide from outlet 104 toward sample region 120. Jet 114 of carbon dioxide undergoes Joule-Thomson cooling which causes at least a portion of the jet 114 to form solid carbon dioxide. At least a portion of the sample is desorbed, with a portion of the desorbed sample being ionized to form sample ions. Electrospray needle 134 is operated to spray charged solvent 136 towards a region between sample region 120 and inlet 110. Charge is transferred from the solvent to a further portion of desorbed sample.

In preferred embodiments, outlet 104 is held at ground potential while emitting jet 114. In other preferred embodiments, outlet 104 is held at elevated potential while emitting jet 114.

A potential may be applied to inlet 110. Preferably, the potential applied to inlet 110 is between 50V and 100V. Heater 118 applies heat to inlet 110, preventing build-up of frost which could prevent sample ions from efficiently entering detector 108: Detector 108 is operated at a lower pressure than the sampling region, causing the sample ions to drift through inlet 110.

In some preferred embodiments, detector 108 is a mass spectrometer. In other preferred embodiments, detector 108 is an ion mobility spectrometer. Detector 108 is operated to produce a signal indicative of the identity of the sample ions. Ion mobility spectrometers that operate at ambient pressure are also known and can likewise be used to analyze ions produced by this invention.

Figure 5:
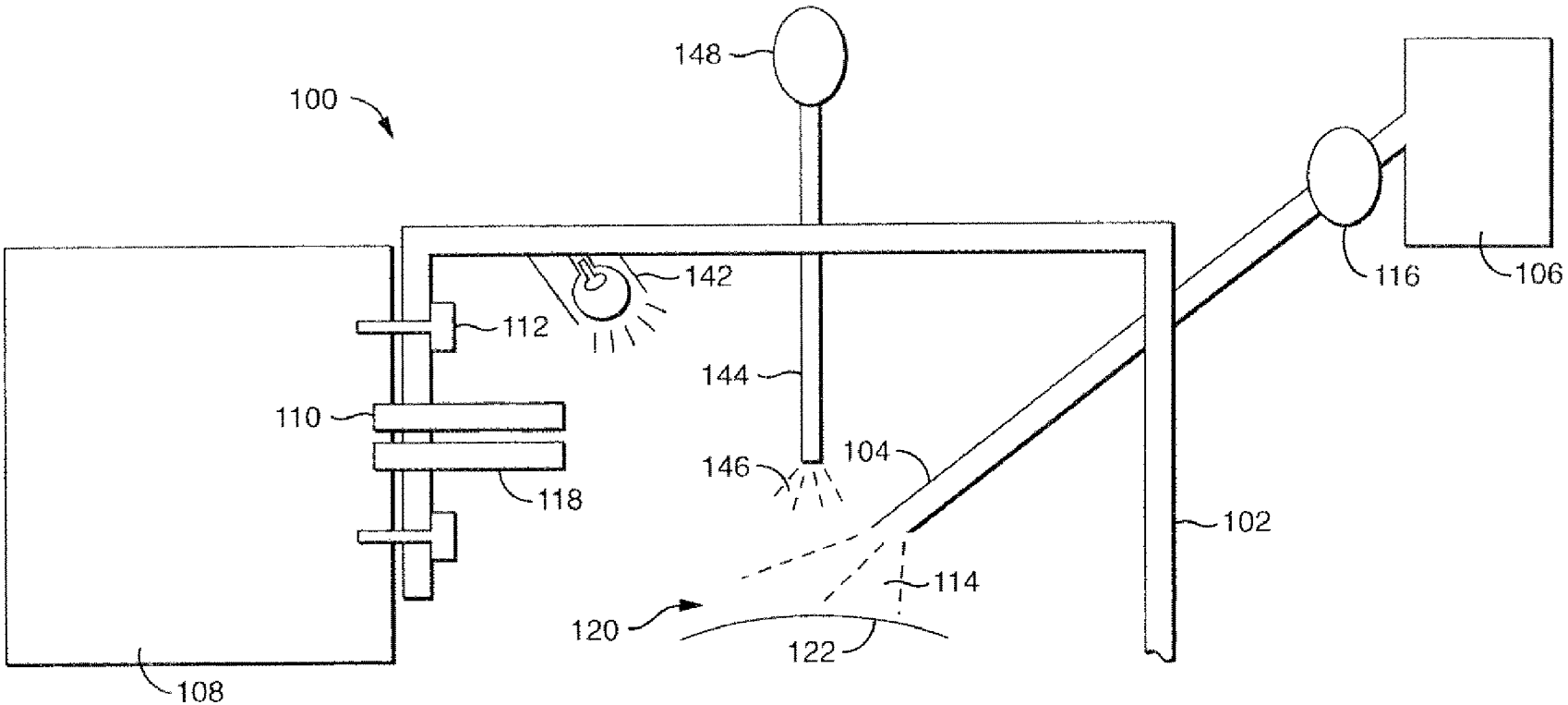
FIG. 5 shows a preferred embodiment of the invention.

A further embodiment of the invention is shown in FIG. 5. A device 100 comprises a frame 102 holding an outlet 104. Outlet 104 may comprise, for example, a tube, pipe or capillary, and is in fluid communication with valve 116, in turn in fluid communication with fluid source 106. Preferably, fluid source 106 contains carbon dioxide under elevated pressure. Valve 116 controls the release of carbon dioxide from fluid source 106 through outlet 104 to affect a jet 114 which forms a sampling region 120. Frame 102 is adapted to receive detector 108 having an inlet 110. Heater 118 is held in thermal communication with inlet 110. Frame 102 may be secured to detector 108 by such means as bolts 112, or by other such means as known in the art. Lamp 142 is secured to frame 102 such that it may provide electromagnetic radiation to sampling region 120. Dopant outlet 144 is secured to frame 102 to supply dopant compound 146 from dopant source 148 to sampling region 120. Dopant compound 146 is selected to be susceptible to ionization under electromagnetic radiation. Preferably, dopant compound 146 is selected to be susceptible to ionization under ultra-violet radiation.

In operation, a sample 122 is placed in sample region 120. Sample 122 may be presented on a surface. Alternatively, sample 122 may be a surface part of a surface itself.

Valve 116 is opened to emit a jet 114 of carbon dioxide from outlet 104 toward sample region 120. Jet 114 of carbon dioxide undergoes Joule-Thomson cooling which causes at least a portion of the jet 114 to form solid carbon dioxide. At least a portion of the sample is desorbed, with a portion of the desorbed sample being ionized to form sample ions. Lamp 142 is operated to provide electromagnetic radiation to sampling region 120, while dopant outlet 144 provides dopant compound 146 to sampling region 120. Dopant compound 146 is ionized by exposure to electromagnetic radiation from lamp 142, and transfers charge to further desorbed sample to produce further sample ions. In preferred embodiments, outlet 104 is held at ground potential while emitting jet 114. In other preferred embodiments, outlet 104 is held at elevated potential while emitting jet 114.

A potential may be applied to inlet 110. Preferably, the potential applied to inlet 110 is between 50V and 100V. Heater 118 applies heat to inlet 110, preventing build-up of frost which could prevent sample ions from efficiently entering detector 108. Detector 108 is operated at a lower pressure than the sampling region, causing the sample ions to drift through inlet 110.

In some preferred embodiments, detector 108 is a mass spectrometer. In other preferred embodiments, detector 108 is an ion mobility spectrometer. Detector 108 is operated to produce a signal indicative of the identity of the sample ions. Ion mobility spectrometers that operate at ambient pressure are also known and can likewise be used to analyze ions produced by this invention.

In another preferred embodiment, the device 100 comprises a frame 102 holding an outlet 104. Outlet 104 may comprise, for example, a tube, pipe or capillary, and is in fluid communication with valve 116, in turn in fluid communication with fluid source 106. Preferably, fluid source 106 contains fluid under elevated pressure. Valve 116 controls the release of fluid from fluid source 106 through outlet 104 to affect a gas jet 114 which forms a sampling region 120. Frame 102 is adapted to receive detector 108 having an inlet 110. Heater 118 is held in thermal communication with inlet 110. Frame 102 may be secured to detector 108 by such means as bolts 112, or by other such means as known in the art. In certain embodiments, an insulating jacket surrounds outlet 104, preventing the build-up of frost. In other preferred embodiments, outlet 104 is movably secured to said frame such that the direction of jet 114 may be adjusted to affect sample vaporization efficiency.

In operation, a sample 122 is placed in sample region 120. Sample 122 may be presented on a surface. Alternatively, sample 122 may be a surface part of a surface itself.

Valve 116 is opened to emit a gas jet 114 from outlet 104 toward sample region 120. At least a portion of the sample is desorbed, to produce gaseous sample. Gaseous sample is the admitted into detector 108. Detector 108 may comprise gas chromatographs, Fourier Transform Infrared spectroscopes, and detectors based on amplifying fluorescent polymers such as are used in the detector called Fido sold by Nomadics, Inc of Stillwater, Okla.

The exact mechanisms of ionization in the embodiments described above are not all known. It is likely, however, that the water vapor content of normal ambient room air, which typically may vary between 30 and 60 percent, is needed to supply the protons to create pseudomolecular ions. In 0 per cent humidity environments, some water vapor may need to be supplied. This could be done by adding water vapor to the sample environment, for example by a second jet or a water reservoir.

Alternatively, liquid water could be premixed with the gas or liquid carbon dioxide prior to jet formation. It is also possible that in some embodiments, other species may usefully contribute to ionization.

It will be recognized that since the desorption induced by the gas jet is localized, that images of localized sample concentrations may be obtained either by scanning the jet or the sample.

it will also be recognized that in some cases if the sample is sufficiently thin, that it may be useful to have the jet impact the sample on the opposite side of the sample from the mass spectrometer inlet.

More generally, it is recognized that substances which exist as gases at atmospheric pressure, can be caused to exist as liquids under pressure, and can be caused to exit from said pressurized environment such that they exist transiently as liquids or solids, may provide a useful means and method for converting solid samples to a vapor phase where they may be conveniently subjected to analysis. The term "gas jet" as used herein is intended to include such jets of such substances. Examples of such substances may comprise some or all of those listed below.

| substance | Formula | BP (° C.) | $P_{vap}$ (psia @ 25° C.) | Tc (° C.) | Pc (psia) | 0.75 Tc (° C.) | 0.75 Pc (psia) |
|---|---|---|---|---|---|---|---|
| Carbon dioxide | $CO_2$ | −78.5 | 860 | 31.1 | 1070 | −45.0 | 803 |
| Nitrous oxide | $N_2O$ | −88.5 | 700 | 36.5 | 1051 | −41.0 | 788 |
| Propane | $C_3H_8$ | −42.1 | 130 | 96.7 | 616 | 4.2 | 462 |
| Ethane | $C_2H_6$ | −88.7 | 570 | 32.3 | 709 | −44.1 | 531 |
| Ethylene | $C_2H_4$ | −103.8 | NA | 9.3 | 731 | −61.4 | 548 |
| Freon 11 | $CCl_3F$ | 23.8 | 15 | 198.1 | 639 | 80.3 | 480 |
| Freon 21 | $CHCl_2F$ | 8.9 | 24 | 178.5 | 750 | 65.6 | 562 |
| Freon 22 | $CHClF_2$ | −40.8 | 140 | 96.1 | 722 | 3.8 | 541 |
| Freon 23 | $CHF_3$ | −82.2 | 630 | 26.1 | 700 | −48.7 | 525 |
| Freon 152A 1,1-difluoroethane | C2H4F2 | −24.9° C. | | | | | |

Additionally it is recognized that while embodiments for the processes heretofore described occur at or near atmospheric pressure, it is possible that it may also be advantageous sometimes to carry out these processes at somewhat or substantially reduced pressures. This may result in increased sensitivity as it may eliminate some of the analyte ion loss that typically results from transporting analyte ions in an atmospheric environment into a vacuum system.

EXAMPLE 1

Figure 6:
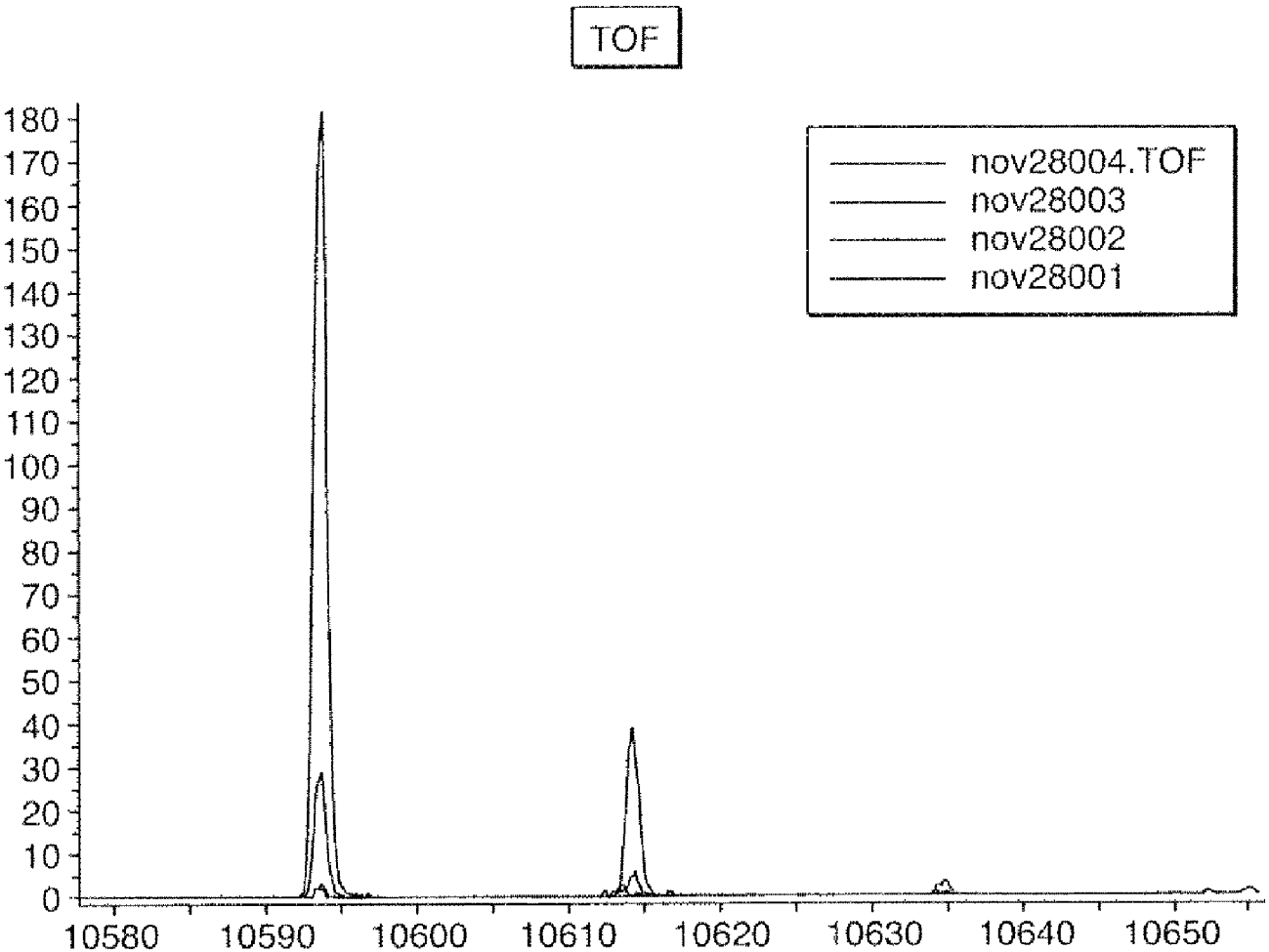
FIG. 6 shows a mass spectrum of Benadryl provided by a device according to the present invention.

An analysis of a tablet of Benadryl, a commercial antihistamine was performed using a device substantially as shown in FIG. 1. The active chemical ingredient in Benadryl is diphenhydramine. A heated inlet tube was attached to a standard Z-Spray interface to an orthogonal TOF mass spectrometer (Waters, Mass.). The inlet was heated to 90° C. and raised to a potential of 65V. A stainless steel capillary tube was used as an outlet. A Benadryl tablet was placed in the sampling region and exposed to a jet of Joule-Thomson cooling CO2. The arrival time spectrum shown in FIG. 6 shows the signal corresponding to diphenhydramine obtained at m/z 256.17, together with the adjacent C13 isotope peak.

EXAMPLE 2

Figure 7:
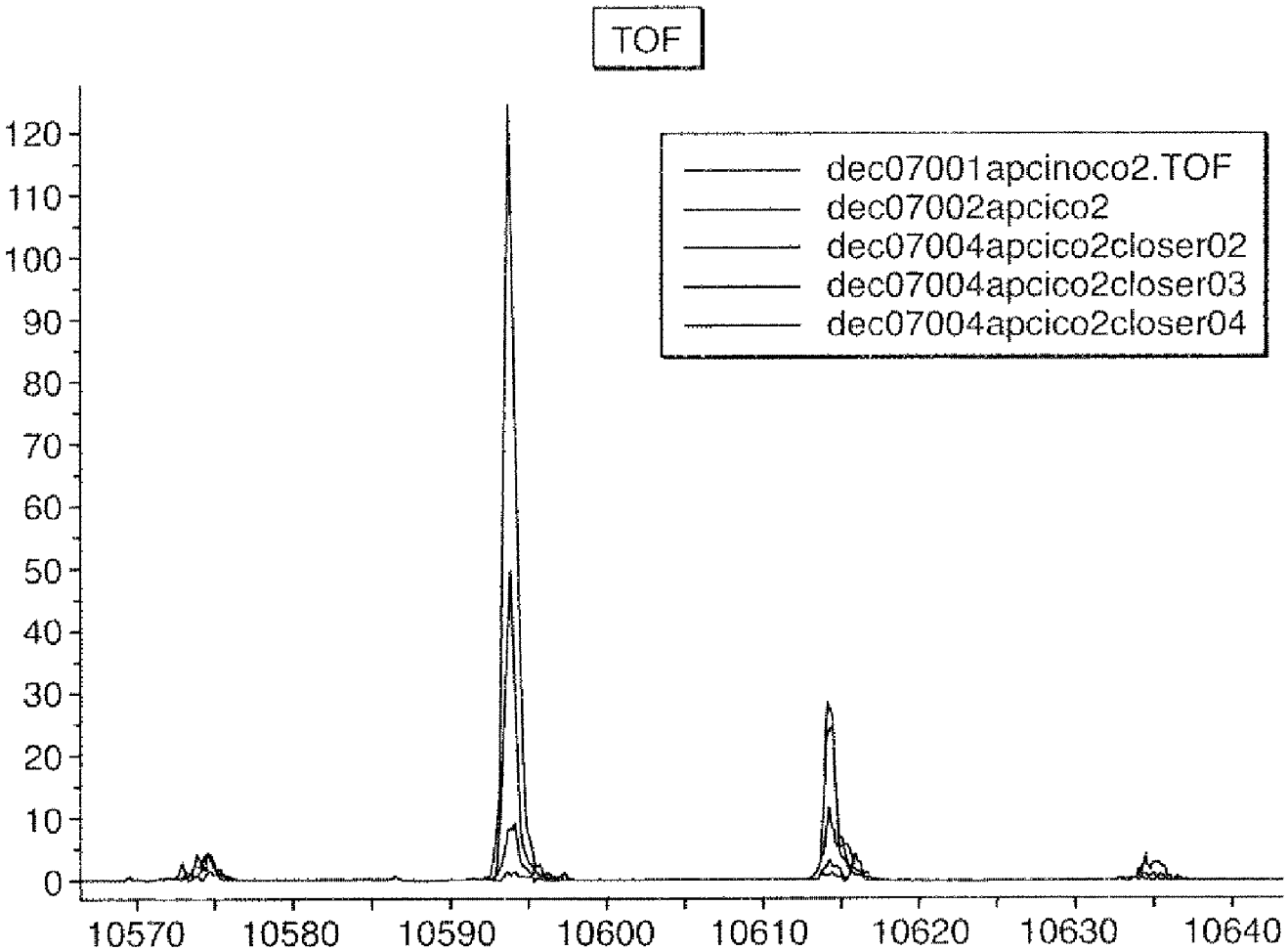
FIG. 7 shows a mass spectrum of Benadryl provided by a device according to the present invention.

An analysis of a tablet of Benadryl was performed using a device substantially as shown in FIG. 2. A heated inlet tube was attached to a standard Z-Spray interface to an orthogonal TOF mass spectrometer (Waters, Mass.). The inlet was heated to 90° C. and raised to a potential of 65V. A stainless steel capillary tube was used as an outlet. The discharge member was raised to a potential of 4000V. A Benadryl tablet was placed in the sampling region and exposed to a jet of Joule-Thomson cooling CO2. The arrival time spectrum shown in FIG. 7 shows the signal corresponding to diphenhydramine obtained at m/z 256.17, together with the adjacent C13 isotope peak. Signal strength was found to be 30-50 times greater than when using the device described in Example 1.

EXAMPLE 3

An analysis of a tablet of Benadryl was performed using a device substantially as shown in FIG. 2. A heated inlet tube was attached to a standard Z-Spray interface to an orthogonal TOF mass spectrometer (Waters, Mass.). The inlet was heated to 90° C. and raised to a potential of 65V. A stainless steel capillary tube was used as an outlet. The area impacted by the CO2 jet was blanketed with an aerosol formed from an eluent comprising methanol with 0.1% acetic acid. The eluent flowed into the aerosol source at 6 μL/min and was nebulized with nitrogen gas. A Benadryl tablet was placed in the sampling region and exposed to a jet of Joule-Thomson cooling CO2.

The invention claimed is:

1. A device for analysing a sample surface comprising:

an outlet and a frame, said outlet for forming a jet of carbon dioxide, said jet forming a sampling region for receiving one or more sample surfaces, and said frame holding said outlet and being adapted to receive a detector means, said detector means having an inlet;

wherein said jet produces desorbed sample from said sample surfaces received in said sampling region, at least a portion of said desorbed sample being ionized to produce one or more sample ions, and said frame holds said outlet with respect to said sampling region and said inlet to allow said detector to receive said sample ions and produce a signal indicative of the composition of said sample ions.

2. The device of claim 1 further comprising a detector means having an inlet configured to receive said sample ions.

3. The device of claim 2 where said inlet is held at an elevated potential.

4. The device of claim 3 where said inlet is held at between +50V and +100V.

5. The device of claim 2 further comprising a heater in thermal communication with said inlet.

6. The device of claim 2 where said inlet is maintained at a temperature between 70° C. and 150° C.

7. The device of claim 1 where said detector means is selected from the group comprising: mass spectrometer, ion mobility spectrometer.

8. The device of claim 1 where said outlet is held at elevated potential.

9. The device of claim 1 further comprising a discharge member held by said frame proximal to said outlet for affecting a discharge, such that at least a further portion of said desorbed sample is ionized to produce further sample ions.

10. The device of claim 9 where said discharge member is held at a potential of 2000V to 6000V.

11. The device of claim 9 further comprising a resistor in series with said discharge member.

12. The device of claim 11 where said resistor provides a resistance of 100MΩ to 6000MΩ.

13. The device of claim 1 further comprising an aerosol source proximal to said outlet for directing an aerosol toward said sampling region.

14. The device of claim 13 where said aerosol source comprises a pneumatic nebuliser.

15. The device of claim 13 where said aerosol comprises methanol.

16. The device of claim 15 where said aerosol further comprises acetic acid.

17. The device of claim 1 further comprising an electrospray needle secured to said frame, said electrospray needle for directing charged solvent droplets toward said sampling region, such that at least a further portion of said desorbed sample is ionized to produce further sample ions.

18. The device of claim 1 further comprising a lamp secured to said frame, said lamp to provide electromagnetic radiation to said sampling region, and a dopant outlet secured to said frame, said dopant outlet to provide a dopant to said sampling region, wherein said dopant is ionized by said electromagnetic radiation to produce dopant ions, such that said dopant ions ionize a further portion of desorbed sample to produce further sample ions.

19. The device of claim 18 where said electromagnetic radiation comprises ultra-violet radiation.

20. The device of claim 1 where said device is operated at atmospheric pressure.

21. The device of claim 1 where said outlet is movable.

22. The device of claim 1 further comprising an insulating jacket surrounding said outlet.

23. A device for analysing a sample surface comprising:

an outlet and a frame, said outlet for forming a jet of Joule-Thomson cooling gas, said jet forming a sampling region for receiving one or more sample surfaces, and said frame holding said outlet and being adapted to receive a detector means, said detector means having an inlet;

wherein said jet produces desorbed sample from said sample surfaces received in said sampling region, at least a portion of said desorbed sample being ionized to produce one or more sample ions, and said frame holds said outlet with respect to said sampling region and said inlet to allow said detector means to receive said sample ions and produce a signal indicative of the composition of said sample ions.

24. The device of claim 23 where said Joule-Thomson cooling gas comprises $N_2O$.

25. A device for analysing a sample surface comprising:

an outlet, a detector means and a frame, said outlet for forming a jet of carbon dioxide, said jet forming a sampling region for receiving one or more sample surfaces, said detector means having an inlet and said frame holding said outlet and said detector means;

wherein said jet produces desorbed sample from said sample surfaces received in said sampling region, at least a portion of said desorbed sample being ionized to produce one or more sample ions, and said frame holds said outlet with respect to said sampling region and said inlet to allow said detector means to receive said sample ions and produce a signal indicative of the composition of said sample ions.

26. A method of ionizing a sample comprising the steps of:

providing an outlet, a detector and a frame, said outlet for forming a jet of carbon dioxide, said jet forming a sampling region for receiving one or more sample surfaces, said detector means having an inlet, and said frame holding said outlet and said detector means;

positioning a sample in said sampling region; and forming a jet of carbon dioxide such that said jet produces desorbed sample from said sample surfaces received in said sampling region, at least a portion of said desorbed sample being ionized to produce one or more sample ions, and said frame holds said outlet with respect to said sampling region and said inlet to allow said detector means to receive said sample ions and produce a signal indicative of the composition of said sample ions.

27. The method of claim 26 further comprising the steps of:

providing a discharge member secured to said frame proximal to said outlet; and applying a potential to said discharge member to affect a discharge such that a further portion of said desorbed sample is ionized to produce further sample ions.

28. The method of claim 27 where said step of applying a potential to said discharge member comprises applying a voltage of 100V to 6000V to said discharge member.

29. The method of claim 26 further comprising the steps of:

providing an aerosol source secured to said frame proximal to said outlet, directing an aerosol from said aerosol source toward said sampling region.

30. The method of claim 26 further comprising the steps of:

providing an electrospray needle secured to said frame proximal to said outlet, said electrospray needle for directing charged solvent droplets toward said sampling region, applying a potential to said electrospray needle; and directing charged solvent droplets towards said sampling region such that at least a further portion of said desorbed sample is ionized to produce further sample ions.

31. The method of claim 26 further comprising the steps of:

providing a lamp secured to said frame, said lamp to provide electromagnetic radiation to said sampling region, and a dopant outlet secured to said frame, said dopant outlet to provide a dopant to said sampling region; and directing a dopant towards said sampling region such that said dopant is ionized by said electromagnetic radiation to produce dopant ions, such that said dopant ions ionize a further portion of desorbed sample to produce further sample ions.

32. A device for analysing a sample surface comprising:

an outlet and a frame, said outlet for forming a jet of gas, said jet forming a sampling region for receiving one or more sample surfaces, and said frame holding said outlet and being adapted to receive a detector means, said detector means having an inlet;

wherein said jet produces desorbed sample from said sample surfaces received in said sampling region, at least a portion of said desorbed sample being ionized to produce one or more sample ions, and said frame holds said outlet with respect to said sampling region and said inlet to allow said detector to receive said sample ions and produce a signal indicative of the composition of said sample ions.

33. The device of claim 32 where said gas is selected from the group comprising: carbon dioxide, nitrous oxide, propane, ethane, ethylene, Freon 11, Freon 21, Freon 22, Freon 23 and Freon 152A 1,1-difluoroethane.

34. A device for analysing a sample surface comprising:

an outlet and a frame, said outlet for forming a gas jet, said jet forming a sampling region for receiving one or more sample surfaces, and said frame holding said outlet and being adapted to receive a detector means, said detector means having an inlet;

wherein said jet produces desorbed sample from said sample surfaces received in said sampling region, and said frame holds said outlet with respect to said sampling region and said inlet to allow said detector to receive said desorbed sample and produce a signal indicative of the composition of said sample.

* * * * *